US010670359B2

(12) United States Patent
Indruch

(10) Patent No.: US 10,670,359 B2
(45) Date of Patent: Jun. 2, 2020

(54) BREECH CATCH MECHANISM FOR AUTOMATIC AND SEMI-AUTOMATIC PISTOLS

(71) Applicant: CESKA ZBROJOVKA A.S., Uhersky Brod (CZ)

(72) Inventor: Jiri Indruch, Valasske Mezirici (CZ)

(73) Assignee: Ceska Zbrojovka A.S., Uhersky Brod (CZ)

( * ) Notice: Subject to any disclaimer, the term of this patent is extended or adjusted under 35 U.S.C. 154(b) by 18 days.

(21) Appl. No.: 15/779,649

(22) PCT Filed: Nov. 25, 2016

(86) PCT No.: PCT/CZ2016/000126
§ 371 (c)(1),
(2) Date: May 29, 2018

(87) PCT Pub. No.: WO2017/097272
PCT Pub. Date: Jun. 15, 2017

(65) Prior Publication Data

US 2018/0259281 A1 Sep. 13, 2018

(30) Foreign Application Priority Data

Dec. 8, 2015 (CZ) ..... 2015-869

(51) Int. Cl.
*F41A 17/36* (2006.01)
*F41A 17/38* (2006.01)

(52) U.S. Cl.
CPC ..... *F41A 17/36* (2013.01); *F41A 17/38* (2013.01)

(58) Field of Classification Search
CPC ..... F41A 17/36; F41A 17/38
(Continued)

(56) References Cited

U.S. PATENT DOCUMENTS 3,540,142 A * 11/1970 Billett ..... F41A 7/02 42/18
3,846,928 A * 11/1974 Ruger ..... F41A 17/36 42/16

(Continued)

FOREIGN PATENT DOCUMENTS

| | | | |
|---|---|---|---|
| DE | 3435809 | A1 | 4/1985 |
| EP | 1566605 | A1 | 8/2005 |
| WO | 2016040217 | A1 | 3/2016 |

OTHER PUBLICATIONS

International Search Report in corresponding Application PCT/CZ2016/000126 dated Feb. 17, 2017 (2 pages).

(Continued)

*Primary Examiner* — Michelle Clement
(74) *Attorney, Agent, or Firm* — Hovey Williams LLP

(57) ABSTRACT

A breech catch mechanism for automatic and semi-automatic pistols includes a catch (502) of a breech comprising two longitudinal rails (400, 401) that are attached to pistol body or to an inserted container at one end in a rotary way and at the other end they are connected with a bridge (402). One of the rails (400, 401) is provided with an internal projection (405) protruding into a space between the rails (400, 401). The mechanism further includes the breech provided with a feeding bridge (250) and a cartridge feeder (500) positioned under the internal projection (405) and configured to push, after feeding of the last cartridge, from below against the internal projection (405), thus tilting the breech catch (502) from its basic position upward to an upper position in which the breech leans with its feeding bridge (250) against an outer surface (408) of the bridge (402) of the catch (502) of the breech to lock the breech in the rear position.

12 Claims, 3 Drawing Sheets

(58) Field of Classification Search
USPC ..... 42/70.02
See application file for complete search history.

(56) References Cited

U.S. PATENT DOCUMENTS 4,142,314 A * 3/1979 Foote ..... F41A 3/82 42/16
4,414,769 A * 11/1983 Mueschke ..... F41A 35/06 42/70.01
4,589,327 A * 5/1986 Smith ..... F41A 17/74 42/70.08
4,681,020 A * 7/1987 Polanecky ..... F41A 9/62 89/138
4,915,011 A * 4/1990 Smith ..... F41A 3/38 89/176
5,070,634 A * 12/1991 Marino ..... F41A 17/42 42/70.01
5,212,327 A * 5/1993 Schuemann ..... F41A 17/32 42/70.01
5,669,169 A * 9/1997 Schmitter ..... F41A 3/66 42/75.01
6,212,814 B1 * 4/2001 Lambie ..... F41A 11/02 42/75.03
6,234,059 B1 * 5/2001 Fuchs ..... F41A 3/66 89/195
6,993,864 B1 * 2/2006 O'Clair ..... F41A 3/14 42/71.02
7,228,780 B1 * 6/2007 Thomele ..... F41A 17/42 42/70.01
7,661,219 B1 * 2/2010 Knight, Jr. ..... F41A 3/42 42/17
8,006,609 B2 * 8/2011 Kallio ..... F41A 17/42 42/14
8,015,742 B2 * 9/2011 Zedrosser ..... F41A 17/36 42/70.04
8,327,749 B2 * 12/2012 Underwood ..... F41A 9/59 89/138
8,359,966 B1 * 1/2013 Brotherton ..... F41A 17/36 42/70.02
9,068,790 B2 * 6/2015 La Vigne ..... F41A 35/06
9,091,499 B2 * 7/2015 Overstreet ..... F41A 3/68
9,915,490 B2 * 3/2018 Gentilini ..... F41A 17/72
9,952,011 B2 * 4/2018 Overstreet ..... F41A 17/36
9,995,549 B1 * 6/2018 Hamby ..... F41A 19/46
10,018,437 B2 * 7/2018 Phipps ..... F41A 3/66
2004/0035286 A1 * 2/2004 Spinner ..... F41A 11/00 89/180
2007/0051236 A1 * 3/2007 Groves ..... F41A 17/16 89/142
2009/0071053 A1 * 3/2009 Thomele ..... F41A 11/02 42/1.01
2009/0249672 A1 * 10/2009 Zedrosser ..... F41A 17/36 42/6
2010/0236394 A1 * 9/2010 Gomez ..... F41A 17/42 89/138
2010/0263254 A1 * 10/2010 Glock ..... F41A 11/02 42/71.02
2010/0275485 A1 * 11/2010 Findlay ..... F41A 17/36 42/16
2010/0281735 A1 * 11/2010 Kallio ..... F41A 15/16 42/25
2011/0219656 A1 * 9/2011 McGarry ..... F41A 11/00 42/70.06
2011/0247482 A1 * 10/2011 Overstreet ..... F41A 9/70 89/138
2011/0247483 A1 * 10/2011 Overstreet ..... F41A 9/70 89/138
2012/0085010 A1 * 4/2012 Cook ..... F41A 17/36 42/7
2012/0192472 A1 * 8/2012 Pflaumer ..... F41A 3/34 42/14
2014/0060310 A1 * 3/2014 Overstreet ..... F41A 3/68 89/138
2014/0338243 A1 * 11/2014 La Vigne ..... F41A 35/06 42/16
2015/0323271 A1 * 11/2015 McGinty ..... F41A 35/06 42/17
2015/0362273 A1 * 12/2015 Foster ..... F41A 17/38 42/6
2016/0146559 A1 * 5/2016 Bantle ..... F41A 17/34 42/16
2016/0258696 A1 * 9/2016 Fluhr ..... F41A 17/36
2016/0320155 A1 * 11/2016 Singh ..... F41A 17/70
2017/0003093 A1 * 1/2017 Spinner ..... F41A 17/72
2017/0045324 A1 * 2/2017 Zeman ..... F41A 17/36
2017/0205173 A1 * 7/2017 Thomas ..... F41A 3/40
2017/0241729 A1 * 8/2017 Gangl ..... F41A 3/66
2017/0284761 A1 * 10/2017 Lewis ..... F41A 3/66
2017/0299303 A1 * 10/2017 Phipps ..... F41A 3/66
2018/0112944 A1 * 4/2018 Underwood ..... F41A 17/28
2018/0149438 A1 * 5/2018 Headrick ..... F41A 9/59
2018/0266778 A1 * 9/2018 Noonan ..... F41A 3/66
2018/0328683 A1 * 11/2018 Shamrai ..... F41A 21/488
2019/0024996 A1 * 1/2019 Borges ..... F41A 3/64
2019/0101345 A1 * 4/2019 Fellows ..... F41A 3/66
2019/0285373 A1 * 9/2019 Palkow ..... F41A 19/16

OTHER PUBLICATIONS

Writtten Opinion of the International Searching Authority in corresponding Application PCT/CZ2016/000126 dated Feb. 17, 2017 (7 pages).

* cited by examiner

BREECH CATCH MECHANISM FOR AUTOMATIC AND SEMI-AUTOMATIC PISTOLS

RELATED APPLICATIONS

This application is the National Stage of International Patent Application No. PCT/CZ2016/000126, filed Nov. 25, 2016, which is hereby incorporated herein by reference in its entirety, and which claims priority to Czech Patent Application No. CZ 2015-869, filed Dec. 8, 2015, which is also incorporated herein by reference in its entirety.

FIELD OF THE INVENTION

The invention relates to a mechanism of a catch of the breech, also called a mechanism of the shooter's preparedness lever for automatic and semi-automatic pistols, which is used to lock the breech in the rear position after firing of the last cartridge from the magazine.

BACKGROUND OF THE INVENTION

An example of the prior-art solutions is described in document U.S. 2014/0338243. According to the solution, breech is arrested in a rear position in a catch being provided in a side of the breech. During both-sided releasing, the control, which is positioned at the opposite side of the catch, is subject to distortion.

Document WO/US2016/040217 describes solution which does not allow for a both-sided releasing of the breech.

In another design, the breech is caught by the feeding bridge, but only unilaterally.

Thus, in the prior-art designs, during the releasing the parts are exposed to asymmetrical forces and consequently to asymmetrical frictional resistances and distortion, which leads to a higher risk of failures and impaired control of the pistol.

SUMMARY OF THE INVENTION

The above mentioned disadvantages of the prior art are eliminated by a breech catch mechanism for automatic and semi-automatic pistols, including a catch of a breech comprising two longitudinal rails that are attached to pistol body or to an inserted container at one end in a rotary way and at the other end they are connected with a bridge, one of the rails being provided with an internal projection protruding into a space between the rails, the breech provided with a feeding bridge and a cartridge feeder positioned under the internal projection and configured to push, after feeding of the last cartridge, from below against the internal projection, thus tilting the breech catch from its basic position upward to an upper position in which the breech leans with its feeding bridge against an outer surface of the bridge of the catch of the breech to lock the breech in the rear position.

In one of the preferred embodiments, the breech catch includes a projection that a spring acts upon to maintain the breech catch in its basic position.

In another one of the preferred embodiments the rails are provided with external projections for manual control of the breech catch to release the breech from the rear position or to lock the breech in the rear position. The internal projection can preferably be located between the place of rotary attachment of the rail to the pistol body or to the inserted container and the external projection.

In one of the preferred embodiments the rotary attachment of the rail to the pistol body or to the inserted container is implemented by means of an opening provided at the end of the rail and a pivot that is a part of the pistol body or of the inserted container.

In another one of the preferred embodiments the rotary attachment of the rail to the pistol body or the inserted container is implemented by means of a projection that is provided on the rail on its inner or outer side at its end and an opening in the pistol body or in the inserted container that the said projection fits into.

BRIEF DESCRIPTION OF THE DRAWINGS

The invention will be clarified in a more detailed way using an example of its embodiment with reference to drawings where.

DETAILED DESCRIPTION OF EMBODIMENTS

Figure 1A:
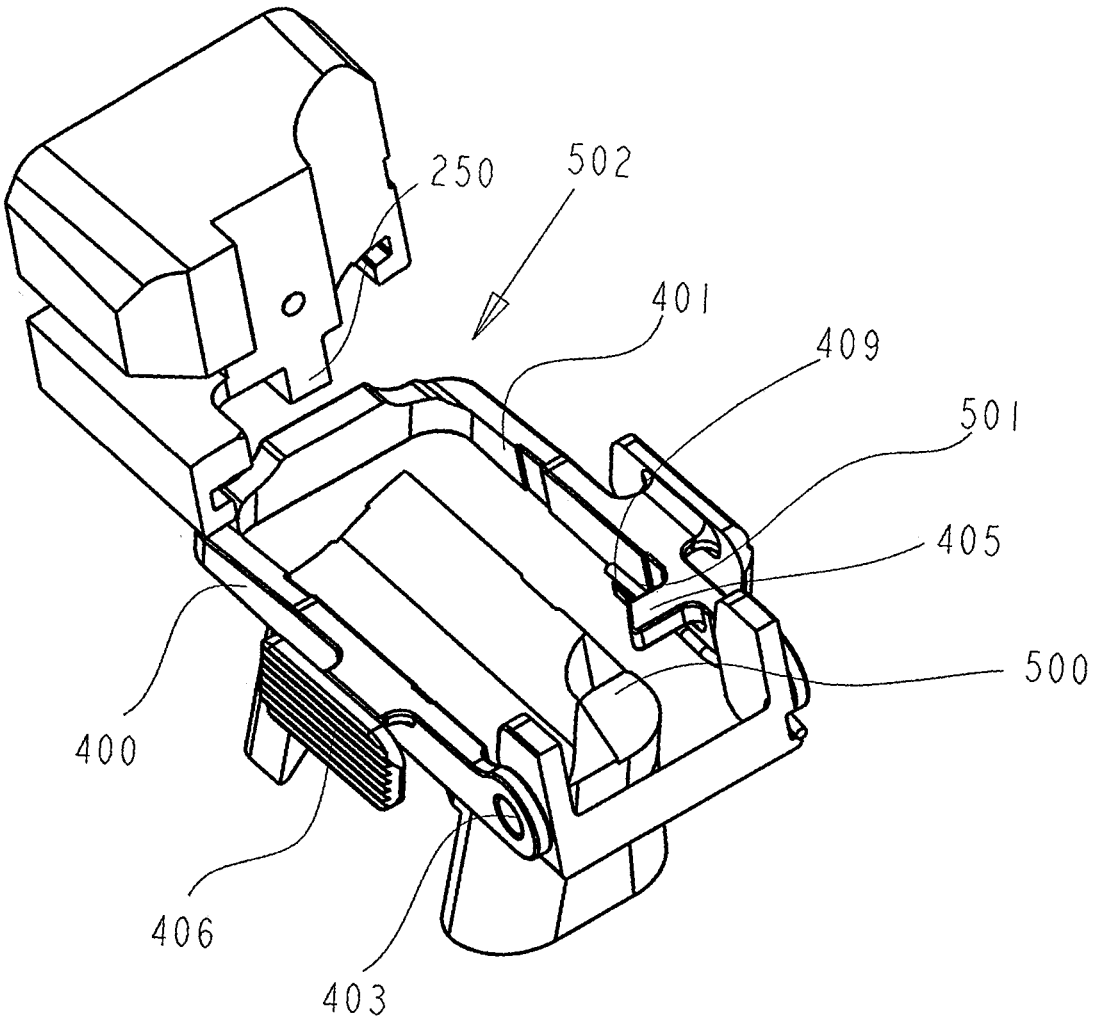
FIG. 1*a* shows a perspective view from one side of an embodiment example of a breech catch mechanism according to the invention.
Figure 1B:
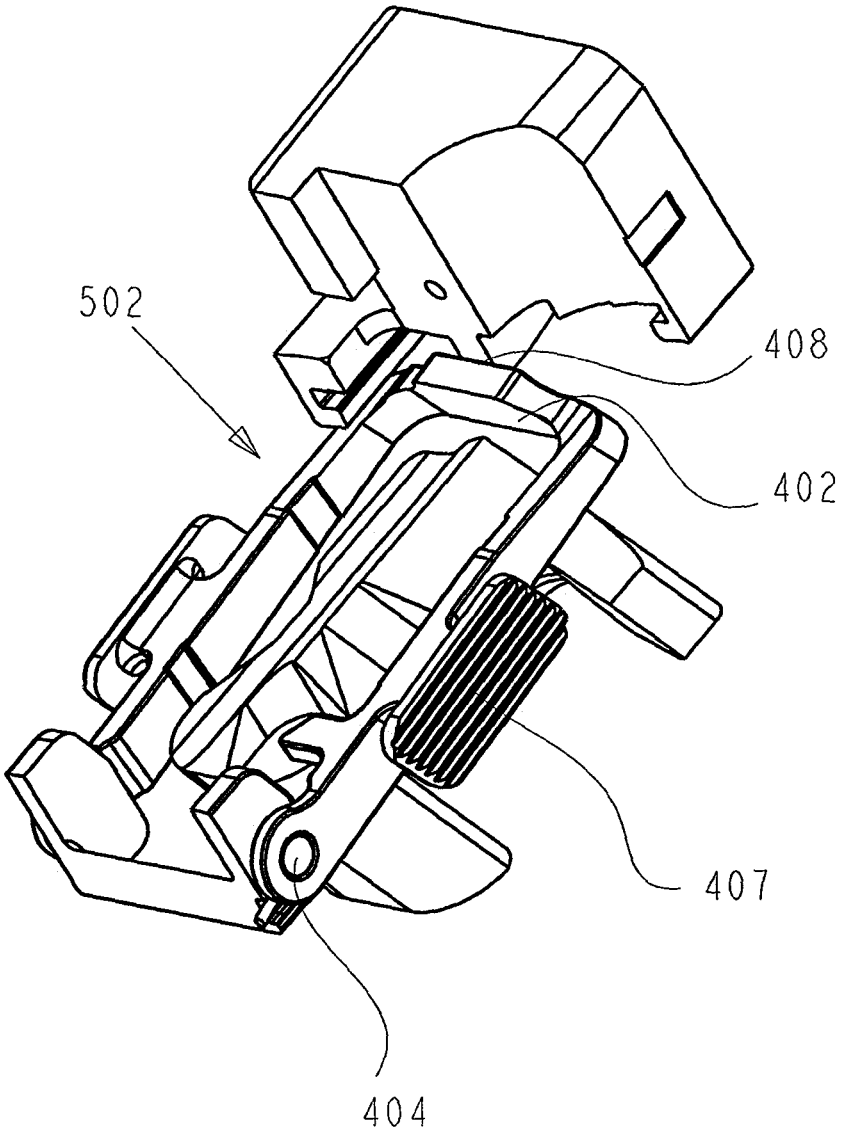
FIG. 1*b* shows a perspective view from the other side of the breech catch mechanism from FIG. 1*a*, but in the position where the breech has been locked after firing of the last cartridge from the breech.
Figure 2:
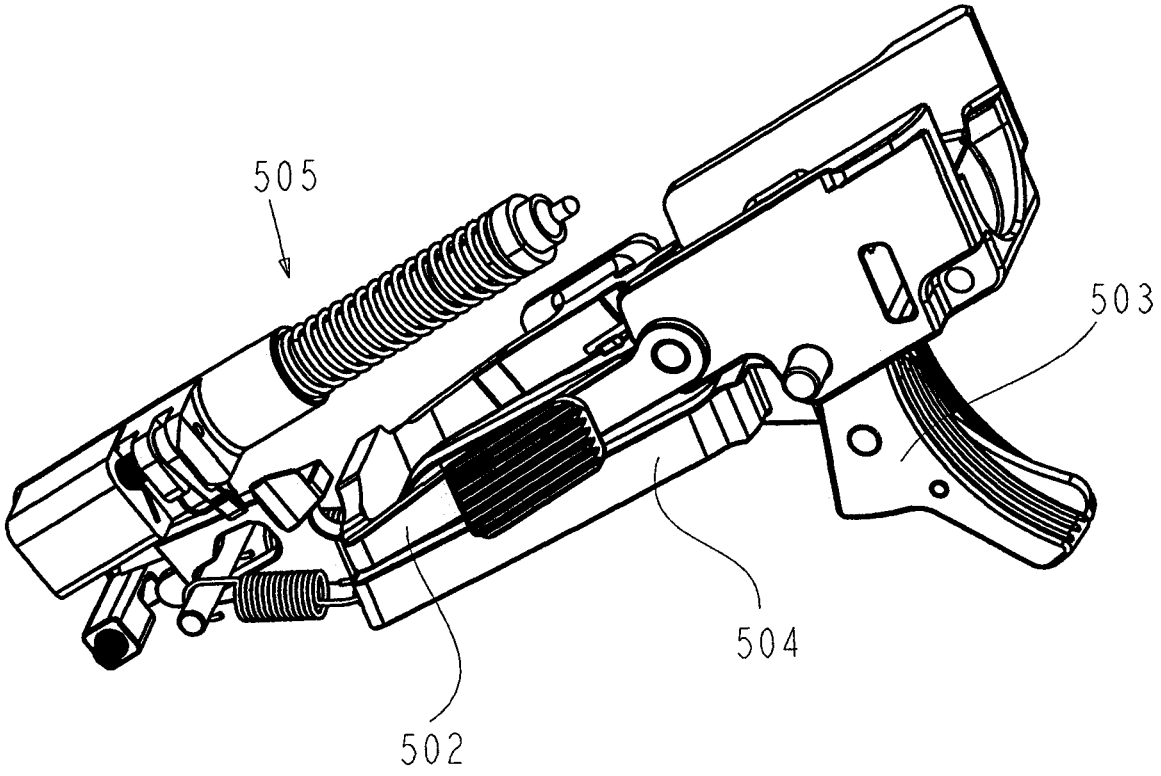
FIG. 2 shows a perspective view of the assembly of the trigger, firing pin and breech catch according to the invention.

FIGS. 1*a* and 1*b* show a perspective view from the both sides of an embodiment example of a mechanism of a catch 502 of breech according to the present invention. The mechanism of the catch 502 of breech includes the breech catch 502, the breech with a feeding bridge 250, and a cartridge feeder 500.

The breech catch 502 for automatic and semi-automatic pistols comprises two parallel rails 400 and 401 that are connected with a bridge 402 in their rear part, forming the shape of the letter U. In the front part there is an opening 403 and 404 provided in either rail, the openings being arranged against each other and their common axis being perpendicular to the longitudinal axis of the breech catch 502. By means of these openings 403, 404 the rails 400 and 401 are mounted on short pivots in a rotary way that may be provided on the pistol body or on an inserted container. In another option these openings 403, 404 may be replaced with projections of a cylindrical shape positioned on the inner or outer side of the rails 400 and 401.

The breech catch 502 is fitted on its rails 400 and 401 with external projections 406 and 407 that are directed outwards from the breech catch 502 perpendicularly to the longitudinal axis of the breech catch 502 and are used for its manual control, i.e. to release the breech from the rear position or to lock it in the rear position.

On one of the rails 400, 401, in the displayed embodiment on rail 401, preferably between the front end with the opening 404 and the external projection 407 an internal projection 405 is arranged that is directed towards the longitudinal axis of the breech catch 502 for the control of the breech catch 502 by the cartridge feeder 500 in the magazine. The cartridge feeder 500 in the magazine pushes this internal projection 405 after feeding of the last cartridge. This causes partial rotation of the breech catch 502 (its tilting or partial tilting upwards) and catching of the breech in the rear position. The breech is caught by the breech catch 502 at its feeding bridge 250 exactly on the longitudinal axis of the breech catch 502. This is achieved by both the longitudinal rails 400 and 401 being mutually interconnected with a bridge 402 the center of which is provided with a surface 408 that the feeding bridge 250 leans against after the lifting of the breech catch 502 during its travel from the rear position, as shown in FIG. 1*b*. Then, to release the catch with the use of the lateral external projections 406 and 407, the same forces must act upon both the external projections 406 and 407, the forces being mutually symmetrical with respect to the longitudinal axis of the catch 502. Thus, the occurrence of asymmetrical frictional forces and consequently distortion of the pistol parts is avoided.

Further, on one of the rails 400, 401 (in the shown embodiment it is on rail 401) a projection 409 is provided that the pressure of the spring 501 that fixes the breech catch 502 in the basic, i.e. non-functional position acts upon. Alternatively, the spring 501 may be designed as a tension spring and in such a case it maintains the breech catch 502 in the basic position by pulling the projection 409. In the rear part, the rails 400 and 401 are connected with a bridge 402 on which a surface 408 is provided on the longitudinal axis for seating of the feeding bridge 250 of the breech during locking of the breech after firing of the last cartridge from the magazine.

The invention is not only limited to the described and displayed example of its embodiment, but it covers all modifications and adaptations that fall within the scope of the patent claims attached below.

LIST OF REFERENCE MARKS

250—breech bridge
400, 401—rail
402—bridge
403, 404—opening
405—internal projection
406, 407—external projection
408—surface
409—projection
500—cartridge feeder
501—spring
502—breech catch
503—trigger
504—trigger lever
505—firing pin

The invention claimed is:

1. A breech catch mechanism for a pistol, the mechanism comprising a breech catch comprising:

(a) a first longitudinal rail comprising a first distal end and a first proximal end, wherein the first longitudinal rail is attached in a rotary way to a pistol body at the first proximal end by means of a first opening;

(b) a second longitudinal rail comprising a second distal end and a second proximal end, wherein the second longitudinal rail is attached in a rotary way to the pistol body at the second proximal end by means of a second opening, wherein the first opening and the second opening comprise a common axis, wherein the common axis is perpendicular to a longitudinal axis of the breech catch;

(c) an internal projection positioned on the first longitudinal rail or the second longitudinal rail, wherein the internal projection protrudes into a space between the first longitudinal rail and the second longitudinal rail; and (d) a breech catch bridge connecting the first longitudinal rail and the second longitudinal rail between the first distal end and the second distal end, wherein the breech catch bridge comprises an outer surface for contacting a feeding bridge provided on a breech, wherein the first longitudinal rail and the second longitudinal rail each have external projections for manual control of the breech catch to release the breech from a rear position or to lock the breech in the rear position.

2. The breech catch mechanism according to claim 1, wherein the breech catch includes a projection that a spring acts upon to maintain the breech catch in a basic position.

3. The breech catch mechanism according to claim 2, wherein the spring biases the breech catch in downward direction relative to the feeding bridge.

4. The breech catch mechanism according to claim 2, wherein the projection is positioned below the internal projection.

5. The breech catch mechanism according to claim 4, wherein the projection and the internal projection are position on the second longitudinal rail.

6. The breech catch mechanism according to claim 1, wherein the internal projection is located between the first proximal end or the second proximal end and the external projection.

7. The breech catch mechanism according to claim 1, wherein the first longitudinal rail is attached in the rotary way to the pistol body and the second longitudinal rail is attached in the rotary way to the pistol body by means of an opening provided at the first proximal end and the second proximal end and a pivot that is a part of the pistol body.

8. The breech catch mechanism according to claim 1, wherein the first longitudinal rail is attached in the rotary way to the pistol body and the second longitudinal rail is attached in the rotary way to the pistol body by means of a projection that is provided on the first proximal end and the second proximal end and an opening in the pistol body that the said projection fits into.

9. The breech catch mechanism according to claim 1, wherein the breech catch bridge includes a protrusion extending at least partially vertically from its top surface, the outer surface for contacting the feeding bridge being located on the protrusion.

10. The breech catch mechanism according to claim 1, wherein the first longitudinal rail, the second longitudinal rail, and the breech catch bridge collectively define an open shape.

11. The breech catch mechanism according to claim 1, wherein the first longitudinal rail, the second longitudinal rail, and the breech catch bridge collectively define an opening through which a cartridge feed may at least partially extend.

12. The breech catch mechanism according to claim 1, wherein each external projection is in a fixed relationship with its respective longitudinal rail.

* * * * *